US009834369B2

(12) United States Patent
Lamboux et al.

(10) Patent No.: US 9,834,369 B2
(45) Date of Patent: Dec. 5, 2017

(54) METHOD FOR EXTRACTING LIQUID FROM A LIQUID DISPENSER BY INJECTING GAS

(71) Applicant: TECHNIPLAST, Louviers (FR)

(72) Inventors: Jean-Philippe Lamboux, Saint Didier des Bois (FR); Loic Bouet, Rouen (FR)

(73) Assignee: TECHNIPLAST, Louviers (FR)

( * ) Notice: Subject to any disclaimer, the term of this patent is extended or adjusted under 35 U.S.C. 154(b) by 0 days.

(21) Appl. No.: 14/678,161

(22) Filed: Apr. 3, 2015

(65) Prior Publication Data

US 2015/0284175 A1 Oct. 8, 2015

(30) Foreign Application Priority Data

Apr. 4, 2014 (FR) ..... 14 52998

(51) Int. Cl.
*B65D 83/14* (2006.01)
*B05B 9/08* (2006.01)
*B05B 11/00* (2006.01)

(52) U.S. Cl.
CPC ..... *B65D 83/14* (2013.01); *B05B 9/0805* (2013.01); *B05B 11/0018* (2013.01); *B05B 11/0097* (2013.01); *B05B 11/3001* (2013.01)

(58) Field of Classification Search
CPC ..... B05B 11/0018; B05B 11/0097; B05B 11/3001; B05B 9/0805; B65D 83/14
See application file for complete search history.

(56) References Cited

U.S. PATENT DOCUMENTS 4,336,895 A * 6/1982 Aleff ..... B05B 11/0016 222/207
4,392,578 A * 7/1983 Fipp ..... B65D 81/2076 215/231
4,735,348 A * 4/1988 Santoiemmo ..... B67D 1/0412 222/399
4,915,601 A * 4/1990 von Schuckmann ..... B05B 11/3059 222/153.13
5,304,165 A * 4/1994 Haber ..... A61J 1/2089 604/411

(Continued)

FOREIGN PATENT DOCUMENTS

EP 1 818 108 A1 8/2007
FR 1423969 A * 1/1966 ..... A45D 34/02

(Continued)

OTHER PUBLICATIONS

FR Search Report, dated Sep. 18, 2014, from corresponding FR application.

*Primary Examiner* — Frederick C Nicolas
*Assistant Examiner* — Bob Zadeh
(74) *Attorney, Agent, or Firm* — Ipsilon USA, LLP

(57) ABSTRACT

A method is provided for extracting liquid from a liquid dispenser The dispenser includes a liquid container and, connected to the container, a liquid dispensing device is able to take up liquid from the container and convey it along a path as far as at least one liquid outlet so as to dispense this liquid to the outside. The method includes a step of injecting a volume of extraction gas under pressure into the container so as to apply pressure to the liquid of the container in order to cause it to flow along at least part of the device and allow a predetermined quantity of liquid to be extracted from the dispenser.

15 Claims, 8 Drawing Sheets

(56) References Cited

U.S. PATENT DOCUMENTS

| | | | | | |
|---|---|---|---|---|---|
| 5,323,935 | A * | 6/1994 | Gosselin | B05B 7/2416 | 222/401 |
| 5,335,703 | A * | 8/1994 | deJong | B65D 83/14 | 134/102.2 |
| 5,511,692 | A * | 4/1996 | Willingham | B67D 1/0802 | 137/614.04 |
| 5,641,094 | A * | 6/1997 | Wunsch | B67D 1/0431 | 222/396 |
| 5,826,756 | A * | 10/1998 | Foster | B05B 11/3001 | 222/321.3 |
| 8,272,538 | B2 * | 9/2012 | Weinberg | B67D 1/0418 | 222/152 |
| 2007/0119875 | A1 * | 5/2007 | Ehret | B67D 1/045 | 222/386.5 |
| 2011/0146207 | A1 * | 6/2011 | Desrues | B65B 31/025 | 53/432 |
| 2015/0284175 | A1 * | 10/2015 | Lamboux | B65D 83/14 | 222/1 |

FOREIGN PATENT DOCUMENTS

| | | | |
|---|---|---|---|
| FR | 2 650 763 | A1 | 2/1991 |
| JP | H10 181783 | A | 7/1998 |

* cited by examiner

METHOD FOR EXTRACTING LIQUID FROM A LIQUID DISPENSER BY INJECTING GAS

The invention relates to a method for extracting a liquid such as scent present in a liquid dispenser.

Conventionally, a liquid dispenser comprises a liquid container and, connected to the container, a liquid dispensing device which is able to take up liquid from the container (generally by pumping the liquid) and convey it along a path as far as at least one liquid outlet so as to dispense this liquid to outside the dispenser.

Conventional dispensers are satisfactory in terms of the functionality of dispensing liquid, notably scent.

However, the liquid dispensing devices present in these dispensers are generally configured to dispense a predetermined dose of liquid. They do not therefore allow this dose to be increased.

Moreover, it is not generally possible to use such a dispenser to refill another container with liquid because the liquid dispensing device mounted on the container is not always removable.

In the light of the foregoing it would therefore be advantageous to be able to extract liquid from a liquid dispenser such as this in a non-conventional way, notably in order to be able to increase the dose of liquid extracted (by comparison with a dose that is predetermined by the configuration of the device) and/or refill another container with liquid.

Thus, one subject of the present invention is a method for extracting liquid from a liquid dispenser which comprises:

a liquid container, a liquid dispensing device which is able to take up liquid from the container and convey it along a path as far as at least one liquid outlet of the device so as to dispense the taken-up liquid to outside the dispenser, the dispenser comprising at least one compensating-air inlet for letting air into the container and which, when open, by letting a volume of air in from outside makes it possible to compensate for a volume of liquid taken up by the device, the device comprising a pumping device for pumping the liquid contained in the container, said pumping device being able to occupy a rest position and, under the action of an actuating command, one or more actuated positions in which or in each of which said at least one compensating-air inlet is open to the outside, characterized in that the method comprises a step of injecting a volume of extraction gas under pressure into the container through said at least one compensating-air inlet open to the outside when the pumping device is in an actuated position, so as to apply pressure to the liquid contained in the container in order to cause it to flow along the liquid-conveying path and thus extract a predetermined quantity of liquid from the dispenser.

Injecting a volume of gas into the container under pressure through the open compensating-air inlet or inlets has the effect of expelling a predetermined quantity of the liquid (corresponding more or less to the volume of gas injected give or take the compression of the gas) from the container into the liquid dispensing device (the device is in communication, on the one hand, with the liquid of said container and, on the other hand, with the outside), and then from the dispenser. The injected gas thus expels the liquid from the container and forces it to be extracted. It will be noted that in order to inject gas and extract liquid, part of the conventional liquid dispensing device (generally an external part) is generally removed (e.g. pushbutton or actuating component), the other part comprising the pumping device being left mounted on the container. The method is particularly simple to implement.

For operation of the dispenser according to the invention, the path conveying the liquid as far as said at least one liquid outlet may, according to circumstances, open only under the pressure/depression created by the injection of the gas and thus be partially open or closed in the actuated position.

In conventional operation, the liquid dispensing device is generally actuated from the outside (for example by a downward vertical pressure which causes the liquid to be pumped) so as to take up a dose of liquid that is predetermined and limited (by the construction of the device) which will then be dispensed to outside.

The pumping device in the actuated position is rendered inoperative, which means that the limitations imposed by the liquid metering connected with the design of the pumping device no longer apply. It is therefore possible to extract liquid through the pumping device without being limited by the inherent metering of the device. The quantity (or volume) of liquid extracted can therefore be increased according to the volume of gas injected.

According to other possible features considered in isolation or in combination with one another:

the method comprises a step of actuating the pumping device so that it occupies an actuated position; alternatively, the liquid dispensing device is designed to force the pumping device into a constantly depressed position;

the liquid container is provided with an opening in which the liquid dispensing device is mounted, said at least one compensating-air inlet being situated level with said opening of the container and being able, on the one hand, to be open to the outside in order to allow compensating air from outside to be let into the container when the pumping device is in the or an actuated position and, on the other hand, to be closed off when the pumping device is in the rest position;

the dispensing device comprises, mounted removably on the pumping device, a system for injecting a volume of gas and for extracting liquid from the dispenser under the action of the injected volume of gas;

prior to the step of injecting a volume of extraction gas, the method comprises a step of mounting the liquid extraction system on the pump device as a replacement for an actuating component which allows only the liquid pumped from the container to be dispensed to outside the dispenser. The conversion from a conventional dispenser to a dispenser according to the invention is therefore particularly simple to effect.

Another subject of the invention is a liquid dispenser comprising:

a liquid container, a liquid dispensing device which is able to take up liquid from the container and convey it along a path as far as at least one liquid outlet of the device so as to dispense the taken-up liquid to outside the dispenser, at least one compensating-air inlet for letting air into the container and which, when open, by letting a volume of air in from outside makes it possible to compensate for a volume of liquid taken up by the device, said device comprising a pumping device for pumping the liquid contained in the container, said pumping device being able to occupy a rest position and, under the action of an actuating command, one or more actuated positions in which or in each of which said at least one compensating-air inlet is open to the outside, characterized in that the dispensing device comprises a system for injecting a volume of gas into the container through said at least one open compensating-air inlet and for extracting liquid under the action of the injected volume of gas.

The injection and extraction system generally replaces part of a conventional dispensing device which acts as an (external) actuating component of the liquid pumping device. The part of the conventional device comprises just one passage for conveying the pumped liquid as far as the dispensing outlet.

Liquid is extracted through the pumping device in an actuated position.

The dispenser is particularly simple in design because it is obtained by replacing part of the dispensing device with an adapted system (interface for letting gas in and letting liquid out).

According to other possible features:

the injection and extraction system is mounted removably on the pumping device;

the injection and extraction system comprises:

at least one injection element injecting a volume of extraction gas through said at least one compensating-air inlet, at least one extraction element for extracting a predetermined quantity of liquid from the dispenser and which comprises said at least one liquid outlet;

said at least one extraction element for extracting the predetermined quantity of liquid from the dispenser comprises a liquid conveying duct, a first, inlet, end of which communicates with the pumping device and an opposite second, outlet, end of which is in communication with the outside, the opposite second, outlet, end comprising a choice of: an outlet orifice, one or more spray orifices, a pouring spout;

said at least one injection element for injecting a volume of gas comprises one or more gas injection ducts; the duct or ducts may communicate via one end with said at least one compensating-air inlet;

the injection and extraction system is mounted in a sealed manner on the pumping device;

the injection and extraction system is mounted on the pumping device in such a way as constantly to apply an actuating command thereto so as to keep the pumping device in an actuated position.

Another subject of the invention is a head for injecting a volume of gas and extracting liquid, which head is intended to be fixed to a pumping device of a liquid dispenser, characterized in that the head comprises:

at least one injection element for injecting a volume of extraction gas which is intended to inject a volume of extraction gas into the dispenser, at least one extraction element for extracting a predetermined quantity of liquid from the dispenser under the action of the injected volume of gas.

This head (system) will be fixed to the pumping device of the liquid dispenser from which the actuating component (dispensing pushbutton) has for example been removed, and it is mounted on the pumping device and, for example, also on part of the dispenser that surrounds this device (e.g.: the neck of the container and/or element that closes the opening of the container).

This head may be configured according to the intended application and in itself contains all of the gas-injecting and liquid-extracting elements mentioned hereinabove. The head acts as something like an interface between the dispenser (or part thereof) and the outside.

According to other possible features:

said at least one injection element for injecting a volume of extraction gas comprises one or more gas injection ducts;

said at least one liquid extraction element comprises a duct for conveying the liquid which has two ends opening to the outside of the head.

Other features and advantages will become apparent during the description which follows, given solely by way of nonlimiting example and made with reference to the attached drawings in which:

FIGS. 1 to 3 illustrate a liquid dispenser according to one embodiment of the invention, in three different positions;

FIGS. 4, 4*b*, and 4*c* are schematic views of a first embodiment of a system for extracting liquid by injecting gas which is associated with part of the dispenser of FIGS. 1 to 3;

Figure 2:
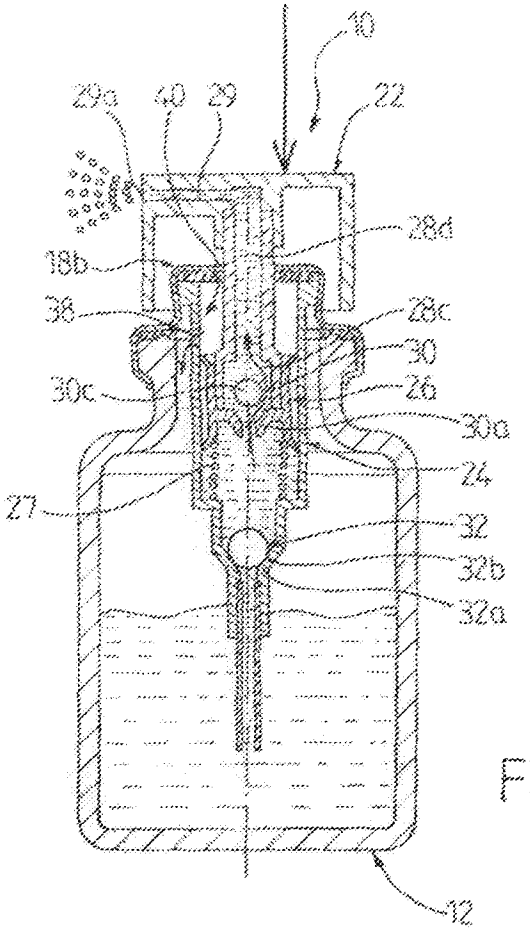
Figure 1:
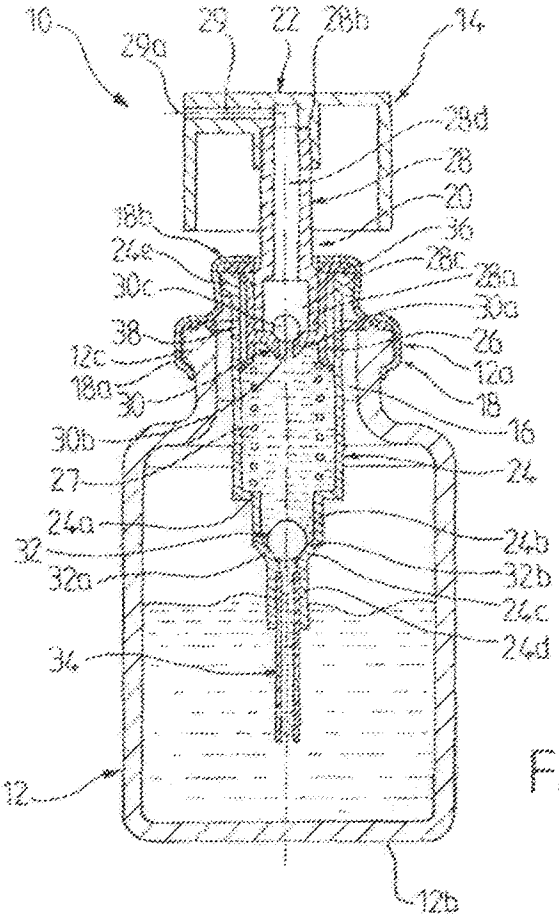
Figure 3:
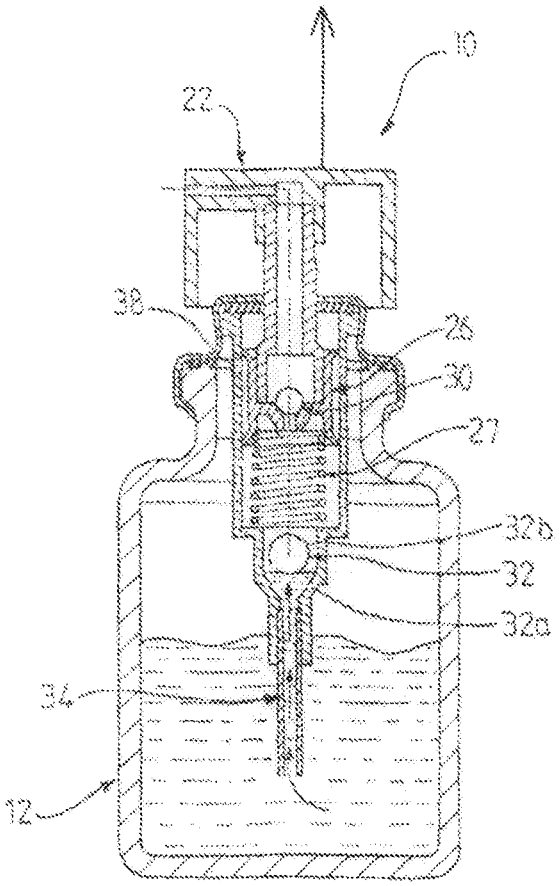

As depicted in FIGS. 1 to 3 and denoted by the general reference denoted 10, a dispenser of liquid such as scent according to one embodiment of the invention comprises, depicted in the normal position of use of the dispenser:

a rigid container 12 containing a liquid (e.g.: scent) to be dispensed to outside said container, for example by spraying the liquid, a liquid dispensing device 14 which is mounted on the container 12 arranged vertically.

More specifically, the container 12 comprises, at its top end 12*a* opposite to the bottom 12*b*, an opening 16 in which part of the device 14 is engaged. The opening 16 is formed at the level of a narrowed section forming the neck of the container. However, the opening could alternatively be made in a container, the upper end of which has a different shape (different neck or no neck). The rigid container is, for example, a glass bottle.

The device 14 is for example fixed to the container by crimping by means of a cap 18 (e.g., made of aluminium) which surrounds part of the device and rests, on the one hand, on said device and, on the other hand, on a rim formed at the level of the neck 12*c* of the container. The cap 18 is configured to hug the external shape of the components that it surrounds.

According to an alternative form of embodiment that has not been depicted, the device is mounted and fixed on the container by screwing at the level of the opening of this container, generally using a screw thread on the interior surface of the wall delimiting the opening (in this instance the wall concerned defines the neck of the container).

The device 14 comprises a pumping device 20 (pump) for pumping the liquid present in the container.

The device 14 also comprises a part referred to as a dispensing part which is situated on the outside of the container (on top of the container in the normal position of use of the dispenser) and which comprises an actuating member or component 22 (dispensing pushbutton) for actuating the pumping of the liquid and dispensing of the pumped liquid to outside the device and therefore the dispenser.

This member is represented here as a dispensing pushbutton which takes the form of a hollow lid or stopper which fits over the pumping device 20. With one finger the user applies downward vertical pressure to the pushbutton 22 as indicated in FIG. 2 in order to pump liquid with a view to dispensing same.

The pumping device 20 comprises:

a body or sleeve 24, a piston 26 which is able to slide along the internal face of the sleeve while ensuring sealed contact between the two components during this movement, and a return spring 27 installed so that it is compressed between the piston situated on top and an internal shoulder 24*a* of the lower part of the sleeve.

The piston 26 comprises a body of which the central part comprises a wall that is pierced so as to place the zones situated on each side of the wall in communication on demand.

The sleeve comprises a part referred to as a chamber inside which the piston moves and which houses the return spring 27. The chamber is delimited at the bottom by the internal shoulder against which the spring rests.

The pumping device also comprises a hollow stem 28 which is fixed at its base 28*a* to the piston 26 and at its opposite end 28*b* to the pushbutton 22. More specifically, the opposite end 28*b* of the stem is fitted into an internal additional thickness of the pushbutton in which a duct 29 is formed for letting liquid out. This duct is in communication with the conduit inside the hollow stem 28. The external action of downward vertical pressure on the pushbutton 22 is transmitted to the stem 28 which presses on the piston and thus allows it to be made to slide towards the bottom part of the sleeve 24, thereby compressing the spring 27 (FIG. 2).

The pumping device also comprises two valve systems 30, 32 (seat and valve shutter): one, 30, is positioned between the piston and the stem and the other, 32, is positioned at the bottom part of the sleeve. Each valve system comprises a valve seat and a valve shutter that is able to move with respect to its seat and adopts for example the form of a ball.

The valve system 30 comprises, on the one hand, a seat 30*a* provided with a through-opening 30*b* which corresponds to the pierced wall of the central part 5 of the piston 26 and, on the other hand, a ball 30*c* which, depending on its position (FIG. 1 or 2) either closes off or does not close off the opening 30*b*. The conduit internal to the hollow stem 28 has a widened part 28*c* in which the ball 30*c* can move when it moves away from the opening and uncovers access thereto. The internal conduit is extended by a part 28*d* of smaller diameter less than that of the ball so as to limit the movement thereof.

The sleeve 24 is extended vertically downwards beyond the internal shoulder 24*a* on which the spring rests by a narrowed first portion 24*b* which, in turn, is connected by a convergent second portion 24*c* to a chimney-forming third portion 24*d*. A suction tube 34 or dip tube is push-fitted into the chimney 24*d* and extends towards the bottom 12*b* of the container.

The valve system 32 comprises, on the one hand, a seat 32*a* which is formed by the convergent second portion 24*c* and, on the other hand, a ball 32*b* which, depending on its position (FIG. 1, 2 or 3) shuts off or does not shut off the inlet to the chimney 24*d*.

As depicted in FIG. 1, the cap 18 comprises a lower portion 18*a* shaped around an external rim of the neck 12*c* of the container. The cap 18 also comprises an upper portion 18*b* which grips the arrangement of the sleeve 24, of the piston 26 and of the stem 28 which are all arranged concentrically. The upper portion 18*b* forms a cover, a first part of which extends substantially axially away from the lower portion 18*a* and a second part of which extends radially towards the stem 28, but leaving a radial space free between said upper portion 18*b* and said stem 28. This radial space forms an inlet for external compensating air entering the container as illustrated in FIG. 2.

In this zone gripped by the upper portion 18*b*, the sleeve at its top end has an external rim 24*e* against which the first part of the upper portion 18*b* presses laterally and against which a component 36 (e.g.: a washer) that forms an axial stop both for the piston 26 and for the stem 28 rests. The stem 28 indeed has an external part with an enlarged external diameter that comes into abutment against the component 36 and therefore remains confined inside the piston and inside the sleeve. It will be noted that the component 36 has an internal diameter greater than the external diameter of the stem 28 in the non-enlarged external part thereof (this part surrounds the reduced-diameter part of the conduit 28*d*) so as to leave a radial space free between the two elements in the position of FIG. 2.

The second part that radially extends the upper portion 18*b* rests against the component 36.

The sleeve 24 also comprises one or more through-holes 38 in its substantially cylindrical wall that delimits the chamber inside which the piston 26 slides.

This or these holes 38 (just one has been depicted in the figures) are made in a zone of the wall at the level (height) of which the piston 26 is positioned when the dispenser is in the rest position of FIG. 1. Thus, the hole 38 places the internal space inside the container in communication with the space situated between the body of the piston 26 and the cylindrical wall of the sleeve (this second space does not communicate with the remaining part of the sleeve because of the sealing of the contact between the body of the piston, via the top and bottom sealing lips, and the wall of the sleeve).

Normal operation of the dispenser 10 will now be described with reference to FIGS. 1 to 3.

In general, the translational movement of the piston in the sleeve (brought about by external actuation on the part of the user) combined with alternating actuation of the two valve systems generates a phenomenon of pumping of the liquid contained in the container. The piston is actuated by the hollow stem into which the liquid that is to be pumped will pass and which is itself actuated by a finger of the user depressing a dispensing pushbutton.

In FIG. 1, in the rest position, the piston 26 is pushed up towards the top of the sleeve 24 (into abutment against the component 36) by the spring 27. The top valve system 30 is closed as is the bottom valve system 32. The pumping device is in the up (rest) position. The dip tube is immersed in the liquid contained in the container.

Once the pumping device has been primed, a volume of liquid is stored in readiness in the sleeve 24, between the piston 26 and the ball 32*b*. This volume of liquid corresponds to the dose of product that will be dispensed by the pumping device in the next pumping operation illustrated in FIG. 2.

As illustrated in FIG. 2, when the user actuates the pushbutton 22 (in the direction of the vertical arrow), the piston 26 slides in the sleeve 24, the top valve system 30 opens (the ball 30*c* moves away from its seat 30*a*), the bottom valve system 32 remains closed, the spring 27 becomes compressed and the axial space between the piston and the ball 32*b* diminishes. The liquid contained in this space passes via the open valve system 30 whereas the closed valve system 32 prevents any delivery of the liquid to the inside of the container. It will be noted that in the design of the dispenser of FIGS. 1 to 3, the valve system 30 opens mechanically via a system of stops when the pumping device is in the bottom pumping position.

The liquid rises up through the conduit parts 28*c*, 28*d* of the stem 28, enters the duct 29 and leaves the latter via the open end 29*a* to be dispensed to outside the dispenser. The liquid therefore follows what is referred to as the normal conveying path to leave the dispensing device and therefore the dispenser. This path comprises the dip tube 34, the open valve system 30, the sleeve 24, the open valve system 32, the conduit parts 28*c* and 28*d* of the stem 28, and the duct 29.

The dose expelled by the pumping phenomenon generates a depression in the sealed and indeformable container, which depression is compensated for by an intake of compensating air into the container in order to restore the equilibrium of the container internal pressure.

At rest (FIG. 1), the dispenser is perfectly sealed against the outside, it being impossible for external air to enter the container. However, when the pumping device is actuated, said sealing is interrupted briefly in order to allow a volume of external air to enter the container to restore the equilibrium of the container internal pressure (a depression caused by the pumped liquid).

The dispenser 10 is thus structured to allow compensating air to enter (intake of air) and, therefore, communication between the outside and the inside of the container, during the pumping. As already described hereinabove, in order to achieve this, one or more compensating-air inlets are formed in the constituent components of the dispenser. The peripheral internal space 40 created between the cap upper portion 18*b* and the stem 28 forms such a compensating-air inlet. This air inlet 40 is placed in communication with the hole 38 in the sleeve when the piston is driven down (FIG. 2) and therefore with the inside of the container, thus creating a passage for conveying outside air into the container as illustrated by the arrows that indicate the path of the air.

In FIG. 3, the user has released his pressure on the pushbutton 22 from a down position (against an end stop) of the pumping device. The return spring 27 returns the piston 26 upwards, the valve system 30 closes and the valve system 32 opens (the ball 32*b* moves away from its seat 32*a*). The space between the piston and the valve system increases, thereby creating a depression and therefore causing liquid to be sucked up by the immersed dip tube 34 (as indicated by the arrows). The liquid rises up inside the tube and begins to fill the internal space of the sleeve via the open valve system 32 in order to culminate in the position of FIG. 1. The air intake passages described hereinabove gradually close as the piston rises back up, notably when the hole 38 is concealed/closed off by the body of the piston 26 reaching the level thereof. The sealing of the dispenser is thus re-established.

Figure 4:
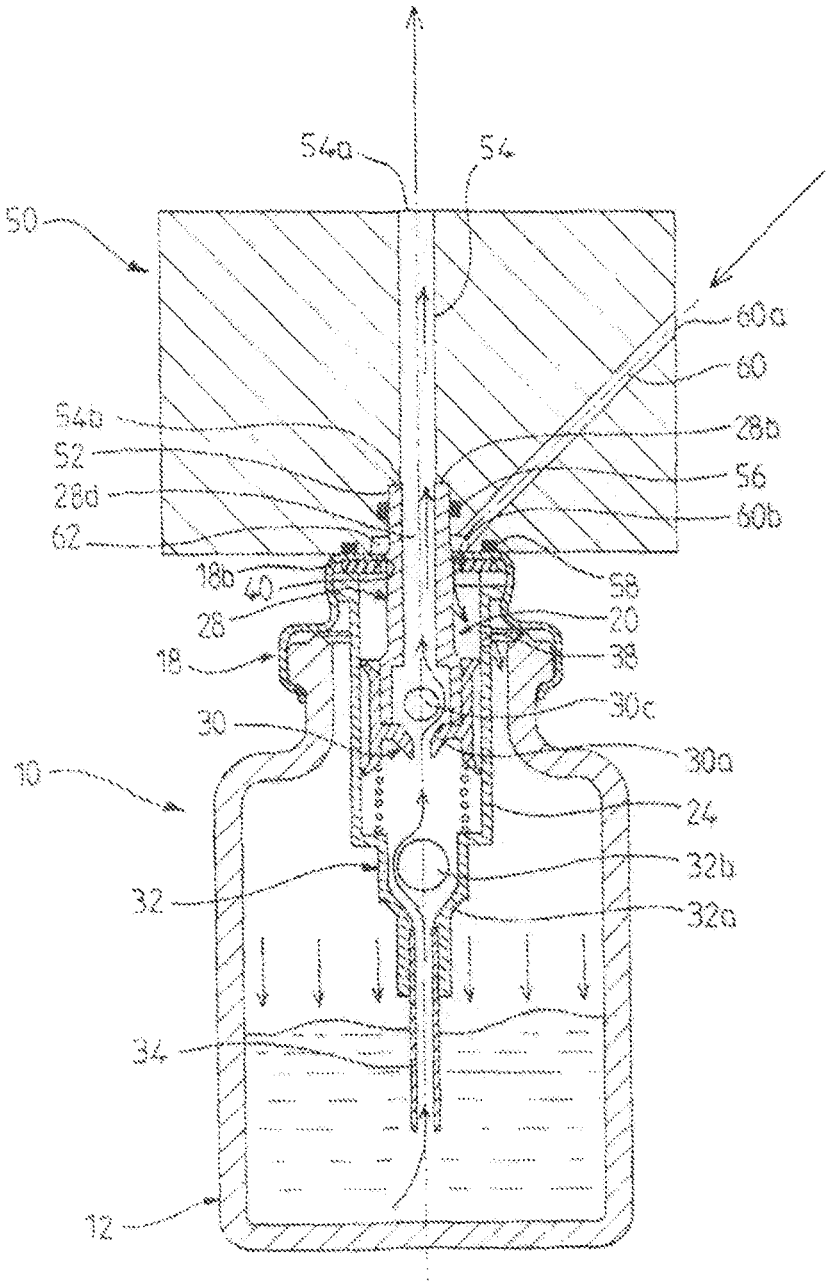
Figure 4B:
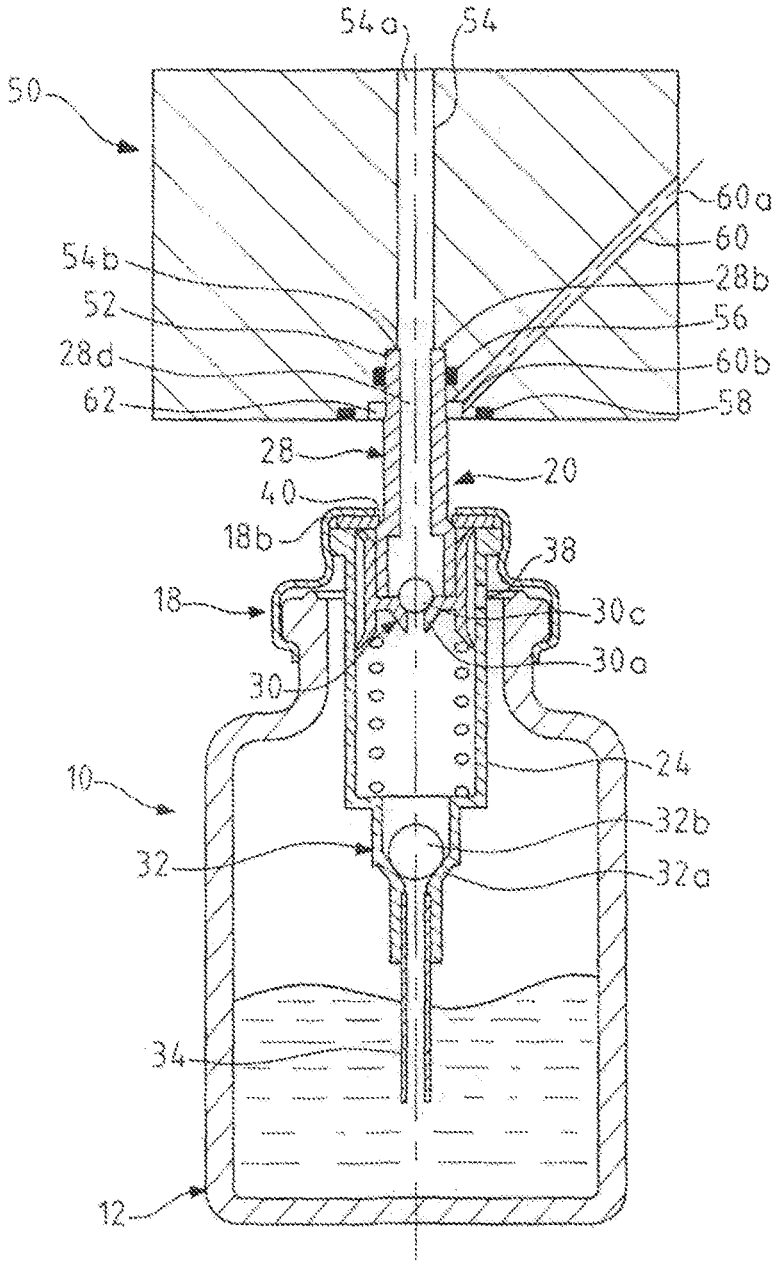
Figure 4C:
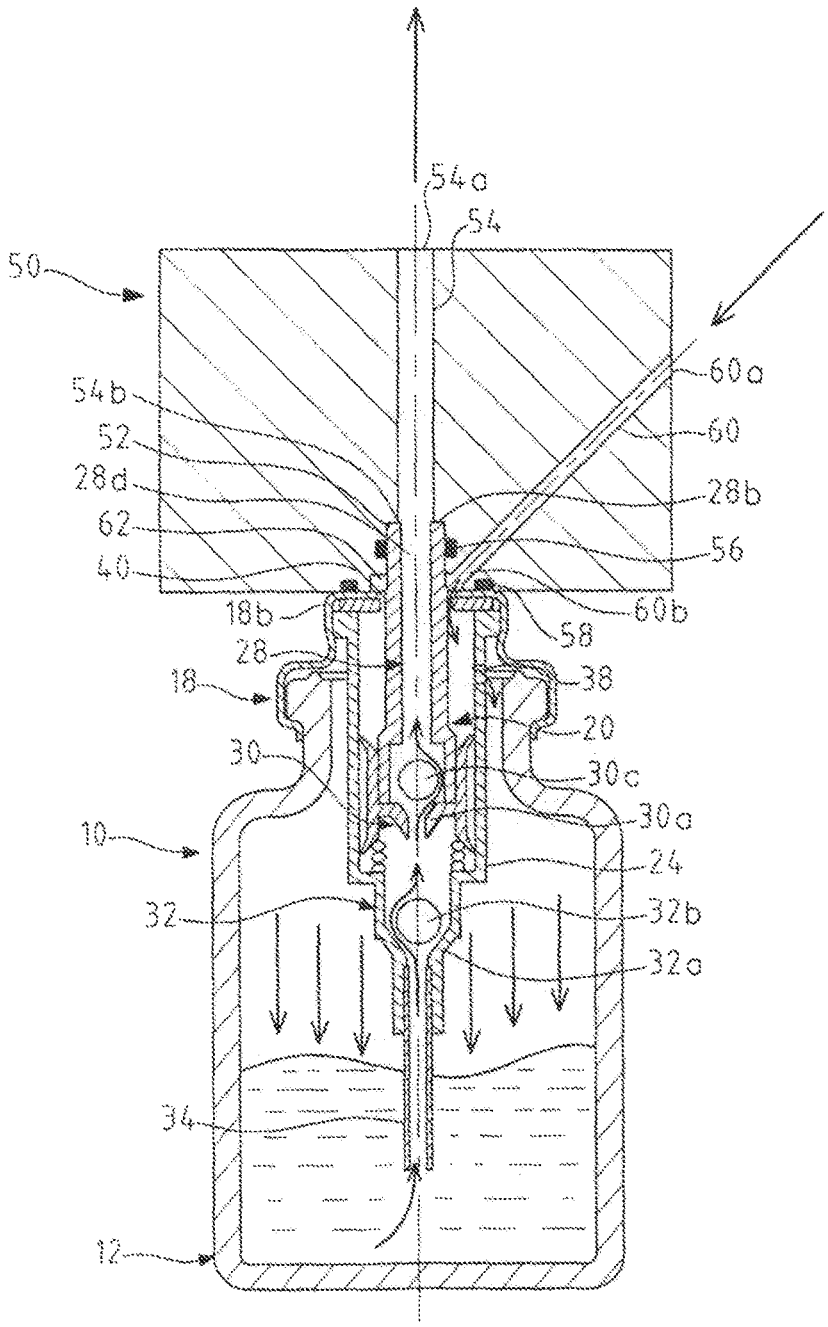

FIGS. 4, 4*b*, and 4*c* illustrate a first embodiment of a liquid dispenser comprising a system for extracting liquid by injecting gas such as air into the dispenser. The dispenser of FIG. 4 reuses part of the dispenser of FIGS. 1 to 3. The same is also true incidentally of the dispenser of FIGS. 5 and 6. FIG. 4 shows the pumping device of the liquid dispenser in a partially activated position. FIG. 4*c* shows the pumping device of the liquid dispenser in a fully activated position. FIG. 4*b* shows the pumping device of the liquid dispenser in a rest position.

Figure 7:
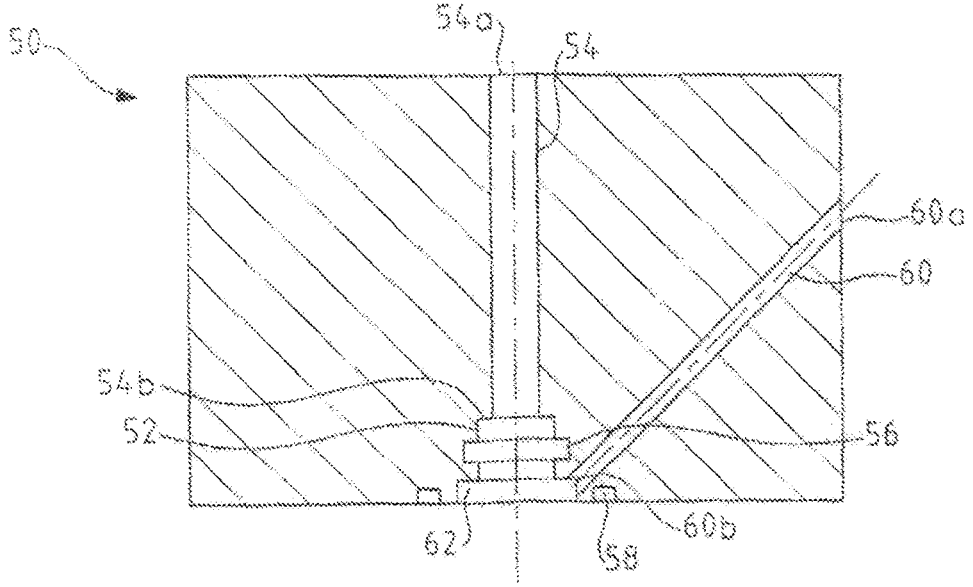
FIG. 7 is a schematic view of the head of FIG. 4.

First of all, the dispensing pushbutton 22 (actuating component) is disconnected and then removed from the dispenser 10 of FIG. 1. Then the dispenser (without the pushbutton 22 but comprising the container and the pumping device), namely the free end 28*b* of the stem 28 protruding from the pumping device and the upper portion 18*b* of the cap 18, is capped with an injection and extraction head 50 (see FIGS. 4 and 7). The injection and extraction head 50 forms an example of a system for extracting liquid from the dispenser 10 by injecting gas. The head 50 comprises an axial housing 52, the diameter of which corresponds to the external diameter of the free end 28*b*, so that part of said free end can be held therein. The head 50 also comprises an axial conduit 54 (duct 5 conveying liquid forming a liquid extraction element external to the pumping device) extending the axial housing 52, of inside diameter corresponding to the inside diameter of the conduit part 28*d*, and opening to the outside via an open outlet orifice 54*a*. The conduit 54 communicates with the stem 28 of the pumping device via its opposite end 54*b*. A peripheral seal 56 is arranged in the axial housing 52 around the free end 28*b* and around a protruding portion of the stem. Likewise, a peripheral seal 58 is arranged in the wall of the head that comes into contact with the upper portion 18*b* of the cap. The filling head 50 also comprises an air injection duct 60 (air injection element) which is made in at least part of the thickness or height of the head. This duct comprises an inlet orifice 60*a* positioned at the level of one of the walls of the head and an outlet orifice 60*b* arranged at the opposite end of the duct and opening into a zone of the head surrounding the stem 28. More particularly, the orifice 60*b* opens into an annular space 62 situated at the entrance to the axial housing 52.

The head 50 thus incorporates within its body both a liquid extraction element and a gas injection element.

The duct 60 in this instance is directed at an angle of inclination of less than 90° with respect to the axis of the axial conduit 54.

The head 50 is mounted on the pumping device (projecting stem 28) and on the external part of the dispenser which closes the container 12 and surrounds the stem. Axial (e.g.: vertical) pressure is then applied to the head 50 in order to actuate the pumping device into a down actuated position and lock the head in this position on the dispenser using one or more locking (e.g.: click fastening) members. This makes it possible to achieve sealed contact with the dispenser and for the head thus locked to apply constantly to the pumping device an actuating command that keeps said device in the actuated position.

It will be noted that the locking member or members for example allow the head to catch on the bottom of the container 12 via the external part thereof.

For that purpose, the locking members comprise for example a number (e.g.: 2, 3, etc) of elastic tabs which extend axially (vertically downwards) from the underside of the head, surround the container and, at their free end, comprise a return to catch on the external edge of the bottom of the container. The tabs have a height (axial extension) suited to ensuring that, once they have caught (by catching) on the edge of the bottom of the container, the head applies constant axial pressure to the pumping device (pressing/depressing it) and thus forces it into an actuated position.

According to an alternative form, the tabs may be replaced by a single locking member such as a skirt surrounding the container and being retained on the edge of the bottom of the container by an internal rim at its end.

It will be noted that other alternative forms may be contemplated, such as one or more locking members secured to the head and being fixed under the external rim of the neck of the container (around the bottom part of the cap 18).

According to another alternative form, one or more locking members independent of the head can grip both the upper face of the head (the face comprising the orifice 54*a*) and the bottom of the container and perform the same function.

The head is thus mounted in a removable but sealed manner on the pumping device.

Extraction of liquid by injection of gas is ready to be performed.

As explained hereinabove, in the actuated position, one or more passages for the intake of air are created in the dispenser by the placing of the peripheral space 40 in communication with the hole or holes 38 (open compensating-air inlet(s)). In the extraction position of FIG. 4, this or these passages are open and air is introduced or injected under pressure (using suitable means such as a piston or the like) via the injection duct 60 (from a pressurized-air source not depicted) into the space 62 then into the passage or passages through the space 40 and the hole or holes 38 to emerge into the container. The pressure on the pumping device renders the latter inoperative (deactivated). The injection pressure varies in a range stretching from 200 mbar to 2 bar.

Following this introduction of a volume of external air (extraction air or, more generally, extraction gas), the volume of air contained in the container increases and as a result supplies pressure to the liquid present in the container. Under the effect of this pressure on the liquid, the latter rises up the dispensing device via the tube 34. The valve system 32 opens under the pressure of the liquid (the ball 32*b* moves away from its seat 32*a* and rises). The valve system 30 is opened (the ball 30*c* moves away from its seat 30*a* and rises) by design because of the pressure on the pumping device. Pushed by the injected air, the liquid is thus forced to circulate in part of the normal liquid conveying path (tube 34, open valve 30, sleeve 24, open valve 32, stem 28) through the liquid dispensing device and then into the axial conduit 54 of the head before being expelled from the dispenser via the orifice 54*a*. The part of the liquid conveying path that is situated in that part of the liquid dispensing device that remains in the dispenser after the dispensing pushbutton has been removed forms an element for extracting liquid from the dispenser.

The liquid conveying path 54 itself forms a liquid extraction element which is present in the system 50 that is added to the dispenser of FIG. 1 after the dispensing pushbutton has been removed.

Because the pumping device is rendered inoperative when it is actuated (partially depressed or otherwise), the quantity of liquid extracted from the dispenser is no longer dependent on this means (the swept volume of the pump) but is dependent on the volume of air injected into the container.

It will be noted that, in order to be able to work, the pumping device of the dispenser of FIG. 4 needs to be actuated into an actuated position (not at rest) in which the compensating-air inlet or inlets is or are open to the outside.

There is no need for the pumping device to be in a down actuated position against its stop in which position the path or passage internal to the pumping device for conveying the liquid is open. Indeed this path can be open, closed or partially open depending on the pumping configurations (ball valves, mechanical valves which by design open only when the pump is pressed right down, etc).

In the example of FIG. 4, the system of valves 30, 32 is open when the pumping device is in the actuated position.

However, in an alternative form that has not been depicted, the head 50 is locked on the pumping device in an intermediate actuated position somewhere between the rest (not actuated) position and the downmost actuated position (against the end stop). The system of valves (and therefore the liquid conveying path) is therefore partially open or closed and will open fully under the pressure of liquid (following the injection of pressurized gas).

According to one alternative form that has not been depicted, the head is mounted on the pumping device so that it is sealed therewith but does not apply continuous mechanical pressure to the device. The pumping device is therefore at rest and is not actuated, by pressing/depressing the head 50, until there is a desire to extract liquid inject gas (like a dispensing pushbutton).

According to another alternative form that has not been depicted, the head may comprise several gas-injecting elements (e.g.: ducts) and/or several liquid extraction elements (e.g.: ducts).

It will be noted that the dispenser of FIG. 4 is depicted in a vertical position, but it may be used in a position that is inclined with respect to this position.

Figure 5:
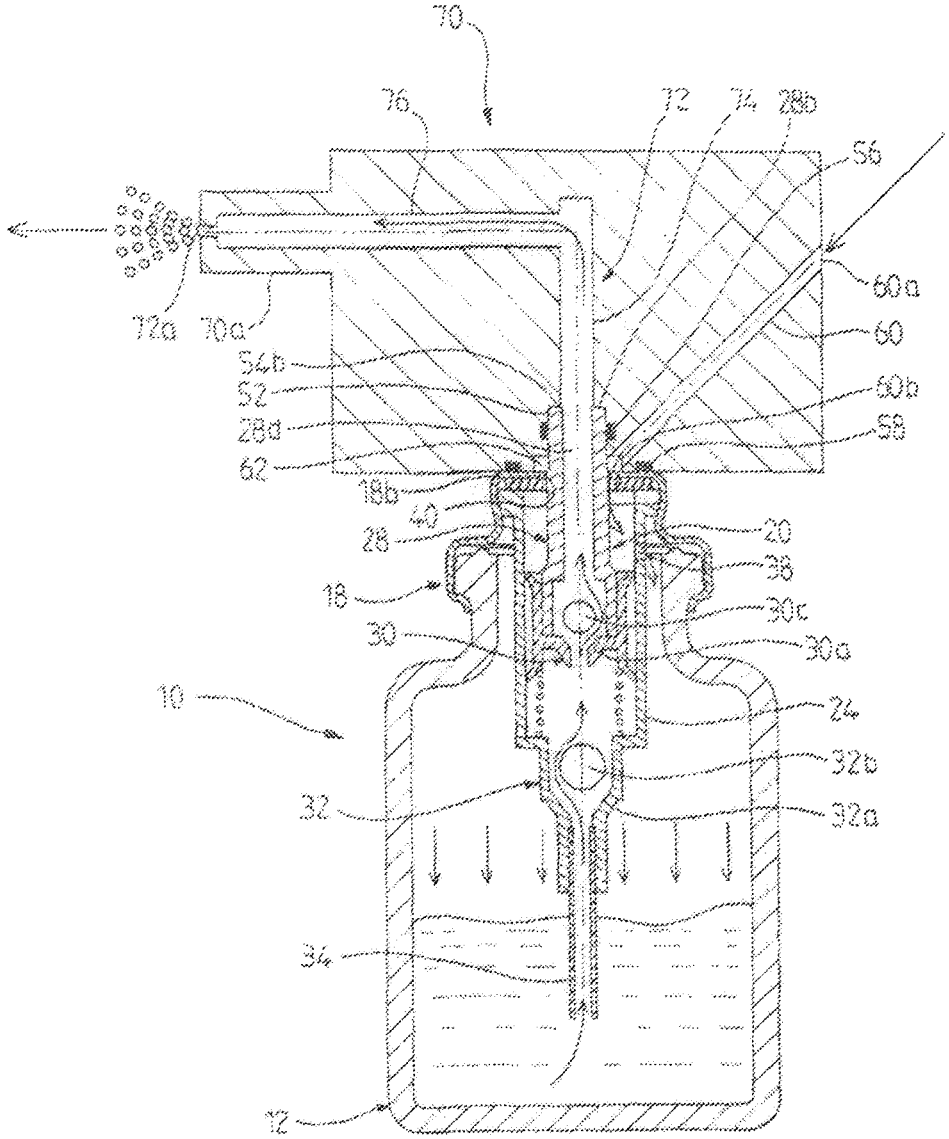
FIG. 5 is a schematic view of a second embodiment of a system for extracting liquid by injecting gas which is associated with part of the dispenser of FIGS. 1 to 3.

FIG. 5 illustrates a second embodiment of a liquid dispenser comprising a system for extracting liquid by injecting gas.

First of all, the dispensing pushbutton 22 (actuating component) is disconnected then removed from the dispenser 10 of FIG. 1. Next, the dispenser (without the pushbutton 22), namely the free end 28*b* of the stem 28 and the upper portion 18*b* of the cap 18, is capped with an injection and extraction head 70. The injection and extraction head 70 forms one example of a system for extracting liquid from the dispenser 10 by injecting gas. The head 70 comprises the axial housing 52 of the head 50 of FIG. 4. The head 70 also comprises an internal liquid conveying duct 72 (the duct 72 forms a liquid extraction element external to the pumping device) which extends the axial housing 52, with an inside diameter corresponding to the inside diameter of the conduit part 28*d*, and opens to the outside via an open spray orifice 72*a* forming a spray nozzle.

The duct 72 forms an elbow and comprises an axial first part 74, along the axis of the axial housing 52, and a second part 76 which extends so that it is perpendicular to the first part and away therefrom, towards the orifice 72*a*. The head 70 comprises a lateral protrusion 70*a* into which a fraction of the second part 76 of the duct and the orifice 72*a* extends in order to lengthen the duct in its part upstream of the orifice. However, it will be noted that this protrusion may in an alternative form be omitted. The open orifice is then created directly in the vertical side wall of the block that forms the head 70.

The dispenser of FIG. 5 incorporating the system 70 works in exactly the same way as the dispenser of FIG. 4: air injected into the container 12 via the open compensating-air inlet or inlets propels the liquid into the liquid dispensing device (without the pushbutton 22) and into the duct 76 so that it can be expelled in the form of a spray jet through the orifice 72*a*.

The same advantages as those mentioned in respect of the embodiment of FIG. 4 apply here, as do the various alternative forms described. The difference between the two embodiments stems from the extraction head, the form in which the liquid leaves this head, and the use to which the extracted liquid is put.

It will be noted that the head 70 is analogous to a pushbutton such as the button 22 except that it incorporates one or more elements for injecting the gas.

According to an alternative form that has not been depicted, the elbow where the first 74 and second 76 parts meet may be rounded in order to improve the flow of liquid in the duct.

Figure 6:
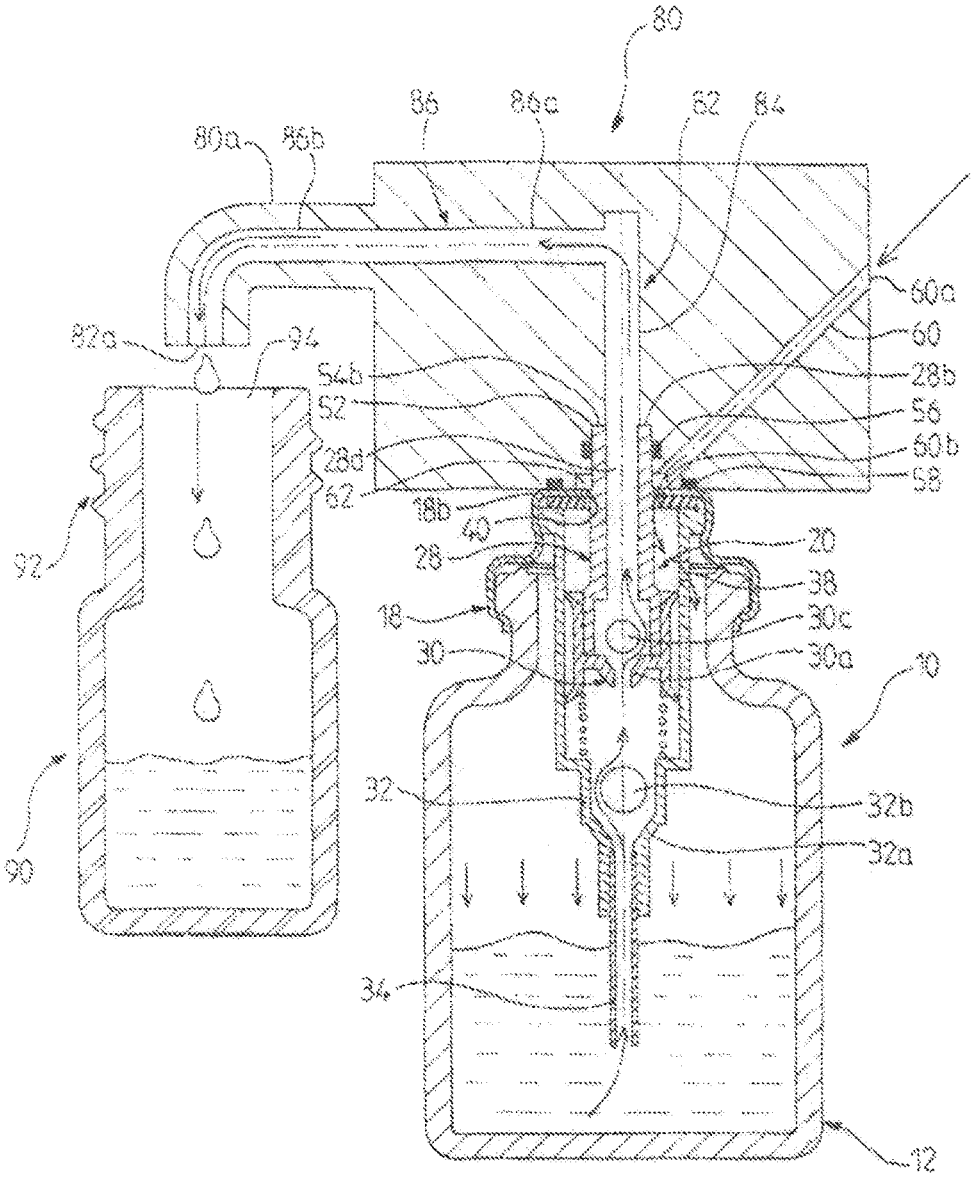
FIG. 6 is a schematic view of a third embodiment of a system for extracting liquid by injecting gas which is associated with part of the dispenser of FIGS. 1 to 3.

FIG. 6 illustrates a third embodiment of a liquid dispenser comprising a system for extracting liquid by injecting gas.

First of all, the dispensing pushbutton 22 (actuating component) is disconnected then removed from the dispenser 10 of FIG. 1. Next, the dispenser (without the pushbutton 22), namely the free end 28*b* of the stem 28 and the upper portion 18*b* of the cap 18, is capped with an injection and extraction head 80. The injection and extraction head 80 forms one example of a system for extracting liquid from the dispenser 10 by injecting gas. The head 80 comprises the axial housing 52 of the head 70 of FIG. 5. The head 80 also comprises an internal liquid conveying duct 82 (the duct 82 forms a liquid extraction element external to the pumping device) which extends the axial housing 52, with an inside diameter corresponding to the inside diameter of the conduit part 28*d*, and opens onto the outside via an open orifice 82*a*.

The duct 82 comprises two parts 84, 86 joined together at right angles 30 like the duct 72 in FIG. 5.

The head 80 also comprises, with respect to the main body, a lateral protrusion 80*a* into which a fraction of the second part 86 of the duct and the orifice 82*a* extends in order to form a pouring spout (tap). The second part 86 thus extends along a first fraction 86*a* so that it is perpendicular to the first part 84 and away from the latter, then along a second fraction 86*b* inside the lateral protrusion 80*a*.

This second fraction 86*b* is straight first of all then bends over downwards as far as the orifice 82*a*.

The dispenser of FIG. 6 incorporating the system 80 works in substantially the same way as the dispenser of FIG. 5: the air injected into the container 12 by the open compensating-air inlet or inlets propels the liquid into the liquid dispensing device (without the pushbutton 22) and into the duct 86 in order to expel it via the orifice 82*a* of the pouring spout in the form of drops of liquid.

As depicted in FIG. 6, another open container or bottle 90 is positioned below the pouring spout 80*a* to collect the drops of liquid extracted from the container 12. That allows the container 90 to be filled.

The container 90 illustrated in FIG. 6 has an external screw thread 92 which allows a pump or a stopper, not depicted, to be attached to the opening 94.

In the field of perfumery, this arrangement means that samples can be created in containers such as the container 90 which are of smaller capacity than the container 12. To do that, the pumping device 20 of the liquid dispensing device crimped onto the container 12 therefore does not need to be removed thanks to the method of extracting liquid according to the invention which has just been described.

The same advantages as those mentioned in respect of the embodiment of FIG. 5 apply here, as do the various alternative fours described. The difference between the two embodiments stems from the extraction head, the form in which the liquid leaves this head, and the use to which the extracted liquid is put.

It will be noted that a gas other than air may be employed. For example, a gas containing no oxygen so as to limit the oxidation of the liquid in the container can be employed. Nitrogen or another inert gas or other gases such as freon or other gases that are similar in terms of their ability to be compressed, may be employed.

The invention claimed is:

1. Method for extracting liquid from a liquid dispenser the liquid dispenser having:

a liquid container, a liquid dispensing device which is able to take up the liquid from the container and convey said liquid along a path as far as at least one liquid outlet of the device so as to dispense the taken-up liquid to outside the dispenser, the dispenser having at least one compensating-air inlet for letting air into the container and which, when open, by letting a volume of the air in from the outside makes possible compensation for a volume of the liquid taken up by said liquid dispensing device, said liquid dispensing device having a pumping device for pumping the liquid contained in the container, said pumping device being able to occupy a rest position and, under an action of an actuating command, one or more actuated positions, in each of said one or more actuated positions said at least one compensating-air inlet is open to the outside, said method comprising, starting from a state where the pumping device occupies the rest position, the steps of:

actuating the pumping device so that the pumping device occupies one position of said one or more actuated positions, no liquid being taken up from the container and no liquid being conveyed along the path at this step, maintaining said one or more actuated positions while a step of injecting a volume of extraction gas under pressure into the container through said at least one compensating-air inlet open to the outside, so as to apply pressure to the liquid contained in the container in order to cause said liquid to flow along the liquid-conveying path and thus extract a predetermined quantity of the liquid from the dispenser.

2. Method according to claim 1, wherein the liquid container is provided with an opening in which the liquid dispensing device is mounted, said at least one compensating-air inlet being situated level with said opening of the container and being able, on the one hand, to be open to the outside in order to allow compensating air from the outside to be let into the container when the pumping device is in the one or more actuated positions and, on the other hand, to be closed off when the pumping device is in the rest position.

3. Method according to claim 2, wherein the dispensing device further comprises, mounted removably on the pumping device, a system for injecting a volume of the extraction gas and for extracting the liquid from the dispenser under the action of the injected volume of the extraction gas.

4. Method according to claim 1, wherein the dispensing device comprises, mounted removably on the pumping device, a system for injecting a volume of the extraction gas and for extracting the liquid from the dispenser under the action of the injected volume of the extraction gas.

5. Method according to claim 4, prior to the step of injecting a volume of the extraction gas, the method further comprising a step of mounting the liquid dispenser on the pumping device as a replacement for an actuating component which allows only the liquid pumped from the container to be dispensed to the outside the dispenser.

6. Method according to claim 1, wherein the step of actuating the pumping device renders a liquid metering of the pumping device inoperative.

7. Liquid dispenser comprising:

a liquid container, a liquid dispensing device which is able to take up liquid from the container and convey said liquid along a path as far as at least one liquid outlet of the device so as to dispense the taken-up liquid to outside the dispenser, at least one compensating-air inlet for letting air into the container and which, when open, by letting a volume of the air in from the outside makes possible compensation for a volume of the liquid taken up by the liquid dispensing device, said liquid dispensing device having a pumping device for pumping the liquid contained in the container, said pumping device being able to occupy a rest position and, when actuated, having one or more actuated positions, such that in each of said one or more actuated positions said at least one compensating-air inlet is open to the outside, wherein the dispensing device comprises a system for injecting a volume of the gas into the container through said at least one open compensating-air inlet and for extracting the liquid under the action of the injected volume of the gas.

8. Dispenser according to claim 7, wherein the liquid dispenser is mounted removably on the pumping device.

9. Dispenser according to claim 8, wherein said dispenser further comprises:

at least one injection element for injecting a volume of extraction gas through said at least one compensating-air inlet, at least one extraction element for extracting a predetermined quantity of liquid from the dispenser and which comprises said at least one liquid outlet.

10. Dispenser according to claim 7, further comprises:

at least one injection element for injecting a volume of the gas through said at least one compensating-air inlet, at least one extraction element for extracting a predetermined quantity of the liquid from the dispenser and which comprises said at least one liquid outlet.

11. Dispenser according to claim 10, wherein said at least one injection element for injecting a volume of gas has one or more the gas injection ducts.

12. Dispenser according to claim 10, wherein said at least one extraction element for extracting the predetermined quantity of the liquid from the dispenser comprises a liquid conveying duct, a first inlet end of which communicates with the pumping device and an opposite second end of which is in communication with the outside, the opposite second outlet end comprising a choice of: an outlet orifice, one or more spray orifices, a pouring spout.

13. Dispenser according to claim 12, wherein said at least one injection element for injecting a volume of the gas has one or more gas injection ducts.

14. Dispenser according to claim 7, wherein said dispenser is mounted in a sealed manner on the pumping device.

15. Dispenser according to claim 7, wherein the system for injection and extraction is mounted on the pumping device in such a way as constantly actuated thereto so as to keep the pumping device in an actuated position.

* * * * *